United States Patent [19]

Yamazoe et al.

[11] 4,365,601

[45] Dec. 28, 1982

[54] METHOD AND APPARATUS FOR CONTROLLING ROTATION SPEED OF ENGINE

[75] Inventors: Hisamitsu Yamazoe; Masumi Kinugawa, both of Kariya; Masaaki Kurii, Kasugai, all of Japan

[73] Assignee: Nippondenso Co., Ltd., Kariya, Japan

[21] Appl. No.: 197,275

[22] Filed: Oct. 15, 1980

[30] Foreign Application Priority Data

Oct. 17, 1979 [JP] Japan ..... 54-134411

[51] Int. Cl.[3] ..... F02D 11/10

[52] U.S. Cl. ..... 123/339; 123/340

[58] Field of Search ..... 123/339, 340, 341

[56] References Cited

U.S. PATENT DOCUMENTS 4,297,978 11/1981 Matsui ..... 123/339

4,305,360 12/1981 Meyer et al. ..... 123/340

4,312,315 1/1982 Takase ..... 123/339

*Primary Examiner*—Ronald B. Cox

*Attorney, Agent, or Firm*—Cushman, Darby & Cushman

[57] ABSTRACT

A method and apparatus for controlling the rotation speed of an engine by the steps of calculating a desired value of the idling rotation speed of the engine, sensing the actual idling rotation speed of the engine, calculating the deviation of the sensed actual idling rotation speed from the desired value, calculating a data of a rotation speed control factor on the basis of the deviation, limiting the control factor to within a control range between an upper limit and a lower limit, storing a correction factor related to a value of the control factor used under a specific operating condition of the engine, calculating the upper limit and the lower limit of the control factor using the value of the correction factor, and controlling the amount of intake air or the amount of the air-fuel mixture supplied to the engine on the basis of the value of the control factor thus calculated.

9 Claims, 7 Drawing Figures

METHOD AND APPARATUS FOR CONTROLLING ROTATION SPEED OF ENGINE

BACKGROUND OF THE INVENTION

This invention relates to a method and apparatus for controlling the idling rotation speed of an internal combustion engine driving a vehicle.

A closed-loop control method for controlling the idling rotation speed of an internal combustion engine driving a vehicle has been proposed in which, in order that the idling rotation speed of the engine can be controlled or maintained at a target or desired value, as designed, in a maintenance-free fashion, an analog computer or a digital computer is employed to calculate the deviation of the actual idling rotation speed of the engine from the desired speed, and then, a value of a control factor suitable for reducing the rotation speed deviation to a null is calculated, so that the amount of intake air or the amount of the air-fuel mixture supplied to the engine can be controlled according to the calculated value of the control factor.

In the prior art control method of the kind above described, however, no consideration is given to the limit of the control factor, and the closed-loop control is carried out only when the engine throttle valve is in its closed position. Thus, when the vehicle is being decelerated by depression of the foot brake pedal, and the actual rotation speed of the engine is lower than the desired rotation speed, the computer will calculate in such a way as to progressively increase the value of the control factor used for controlling the amount of intake air or the amount of the air-fuel mixture supplied to the engine, that is, in such a way as to progressively increase the rotation speed of the engine. Consequently, the rotation speed of the engine may become unusually high when the vehicle driver releases his foot from the foot brake pedal or disengages the clutch.

On the other hand, when the vehicle is running down a slope with engine braking or when the vehicle is in engine racing condition with the driver's foot being disengaged from the accelerator pedal, and the actual rotation speed of the engine is higher than the desired rotation speed, the computer will calculate in such a way as to progressively decrease the value of the control factor, that is, in such a way as to progressively decrease the rotation speed of the engine. Stalling of the engine will result when the vehicle driver disengages the clutch in such a state.

Thus, the computer controls the rotation speed of the engine against the will of the vehicle driver, and the vehicle driver will feel uneasy or unpleasant when the vehicle is running at a speed near the designed idling rotation speed of the engine.

The above problem can be solved by setting an upper limit and a lower limit of the control factor and limiting the control factor to within the range between the upper limit and the lower limit. However, such a manner of idling rotation speed control will become no more effective when dust and other foreign particles accumulate on the throttle valve or in a bypass passage bypassing the throttle valve due to a long period of time of use (aging) of the engine. This is because the value of the control factor used for the closed-loop control will become excessively large in such a situation until finally the relation between the control factor and its upper and lower limit will not be appropriate any more for the purpose of rotation speed control, and an engine trouble such as stalling of the engine will occur during a variation in the load or in a transient state of engine operation.

SUMMARY OF THE INVENTION

With a view to obviate the aforementioned defects of the prior art control method, it is a primary object of the present invention to provide an improved method and apparatus for controlling the rotation speed of an engine in which the relation between the control factor and its upper and lower limits can always be maintained appropriate for the control purpose regardless of accumulation of dust and other foreign particles on the throttle valve and in the throttle bypass passage so that an undesirable engine trouble such as stalling of the engine cannot occur during a variation in the load or in a transient state of engine operation.

The control method according to the present invention is specifically featured by the fact that the idling rotation speed is controlled by limiting the control factor to within a limited range between an upper limit and a lower limit, storing in a memory a correction factor related to the value of the control factor used when the rotation speed of the engine is controlled to be close to the desired rotation speed under a specific operating condition of the engine, and correcting the upper limit and lower limit of the control factor depending on the value of the correction factor stored in the memory, whereby the prior art defects can be obviated.

An apparatus for carrying out an embodiment of the control method according to the present invention will be described with reference to the accompanying drawings.

DESCRIPTION OF THE PREFERRED EMBODIMENT

Figure 1:
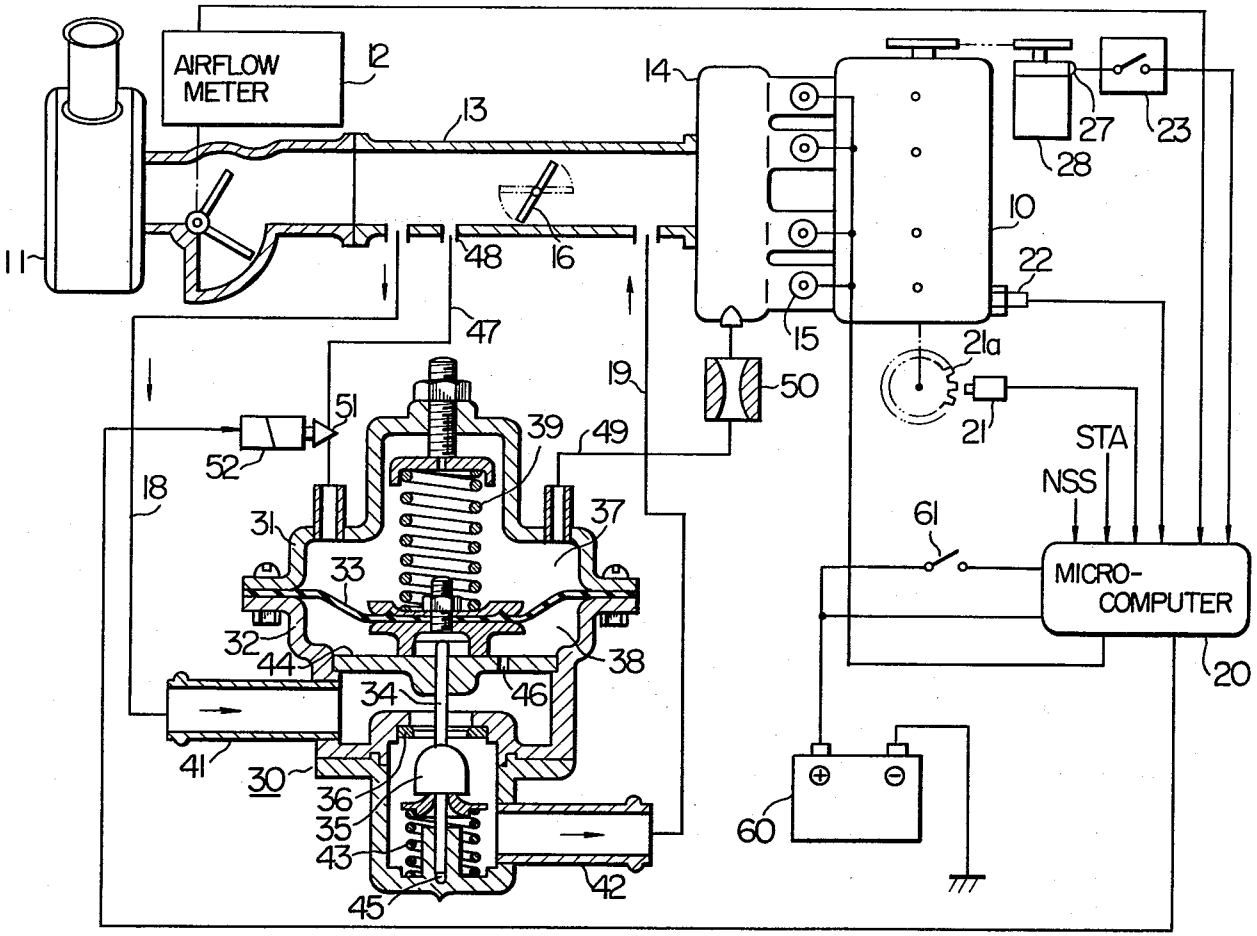
FIG. 1 is a diagrammatic view showing the general structure of an embodiment of the apparatus according to the present invention.

Referring to FIG. 1, the reference numeral 10 designates a known four-cycle internal combustion engine of spark-ignition type driving a vehicle. Primary air is supplied to the engine 10 through an air cleaner 11, an air flow meter 12, an intake pipe 13 and an intake manifold 14, and fuel such as gasoline is injected from a plurality of electromagnetic fuel injection valves 15 disposed in the intake manifold 14.

The amount of primary air supplied to the engine 10 is regulated by a throttle valve 16 actuated as desired by depression of an accelerator pedal (not shown), while the amount of injected fuel is regulated by a microcomputer 20. This microcomputer 20 is of the type commonly known in the art, in which the rotation speed of the engine sensed by an electromagnetic pickup 21 functioning as a rotation speed sensor and the amount of intake air measured by the air flow meter 12 are used as the basic parameters for determining the amount of fuel to be injected. Another signal is also applied to the microcomputer 20 from a warm-up sensor 22 sensing the temperature of engine cooling water, so that the microcomputer 20 can control the rate of increase or decrease in the amount of fuel to be injected.

Air conduits 18 and 19 extend from the intake pipe 13 to bypass the throttle valve 16, and an air control valve 30 is connected between these two conduits 18 and 19. One end of the air conduit 18 is connected to an air inlet port formed in the wall of the intake pipe 13 between the throttle valve 16 and the air flow meter 12, and one end of the air conduit 19 is connected to an air outlet port formed in the wall of the intake pipe 13 at a position down-stream of the throttle valve 16.

The air control valve 30 is of the diaphragm type in which the axial movement of a diaphragm 33 sandwiched at its outer peripheral edge between valve housing portions 31 and 32 is transmitted to a valve member 35 fixed to a shaft 34 so as to move the valve member 35 toward and away from an associated valve seat 36. The diaphragm 33 is displaced by the pressure difference between a diaphragm chamber 37 and an atmospheric pressure chamber 38 and is normally biased by a compression spring 39 in a direction in which the valve member 35 is urged away from the valve seat 36.

The valve member 35 is basically a needle valve member, and the flow restricting area defined between it and the valve seat 36 is continuously varied in proportion to the displacement of the diaphragm 33, hence, depending on the internal pressure of the diaphragm chamber 37 so as to regulate the flow rate of secondary air flowing from an inlet pipe 41 toward an outlet pipe 42. It will be noted that this valve member 35 is disposed to move in a direction reverse to the direction of movement of a conventional needle valve member and is normally biased by a relatively weak compression spring 43 in a direction in which the valve member 35 is urged toward the valve seat 36.

Thus, the operation of this valve member 35 is contrary to the usual operation of a conventional needle valve member, and the valve member 35 is urged in the valve opening direction as the internal pressure of the diaphragm chamber 37 increases toward the atmospheric pressure, while it is urged in the valve closing direction as the internal pressure of the diaphragm chamber 37 decreases toward a vacuum. The air control valve 30 is so constructed that the flow rate Q of secondary air passing therethrough varies as an exponential function of the stroke L of upward lift of the valve member 35 from the lowermost position shown in FIG. 1, in which position the stroke of lift (the amount of displacement) of the valve member 35 is zero since the valve 30 is in its full open position.

A supporting plate 44 is fixedly mounted in the valve housing portion 32, and the shaft 34 is movably supported or guided at one end thereof in a central hole of the supporting plate 44 and at the other end thereof in a supporting hole 45 provided at the bottom of the valve housing portion 32. A port 46 of small diameter extends through the supporting plate 44 so that the atmospheric air can be admitted into the atmospheric pressure chamber 38 through this port 46.

Another conduit 47 which admits the atmospheric pressure into the diaphragm chamber 37 connects the diaphragm chamber 37 to a port 48 formed in the wall of the intake pipe 13 at a position upstream of the throttle valve 16, and another conduit 49 and an orifice 50 which admit the negative pressure or vacuum into the diaphragm chamber 37 connect the diaphragm chamber 37 to the intake manifold 14 disposed downstream of the throttle valve 16. An on-off type electromagnetic valve 51 having an electromagnetic coil or solenoid 52 is disposed midway of the conduit 47 to open and close this conduit 47 as desired thereby suitably controlling the internal pressure of the diaphragm chamber 37.

The electromagnetic valve 51 is electrically connected to the microcomputer 20 which controls the energization of the electromagnetic coil 52.

The microcomputer 20 is electrically connected to the electromagnetic pickup 21, to the warm-up sensor 22 and to an air conditioner switch 23 turning on-off a vehicle's air conditioner such as a cooler. Thus, an engine rotation speed signal, an engine cooling water temperature signal and an air conditioner on-off signal are applied to the microcomputer 20. Besides the above signals, an intake air flow-rate signal AFM from the air flow meter 12, a starter signal STA from the starter for the engine 10 and a neutral safety signal NSS from a torque converter in an automatic transmission (not shown) are also applied to the microcomputer 20.

The electromagnetic pickup 20 is disposed opposite to a ring gear 21*a* mounted for rotation in synchronism with the crankshaft of the engine 10 to generate a pulse signal having a frequency proportional to the rotation speed of the engine 10. The warm-up sensor 22 includes a temperature sensing element such as a thermistor and senses, for example, the temperature of engine cooling water which is representative of the engine temperature.

When the air conditioner switch 23 is turned on, a magnetic clutch 27 is engaged to add the compressor 28 of the air conditioner to the load of the engine 10.

Figure 2:
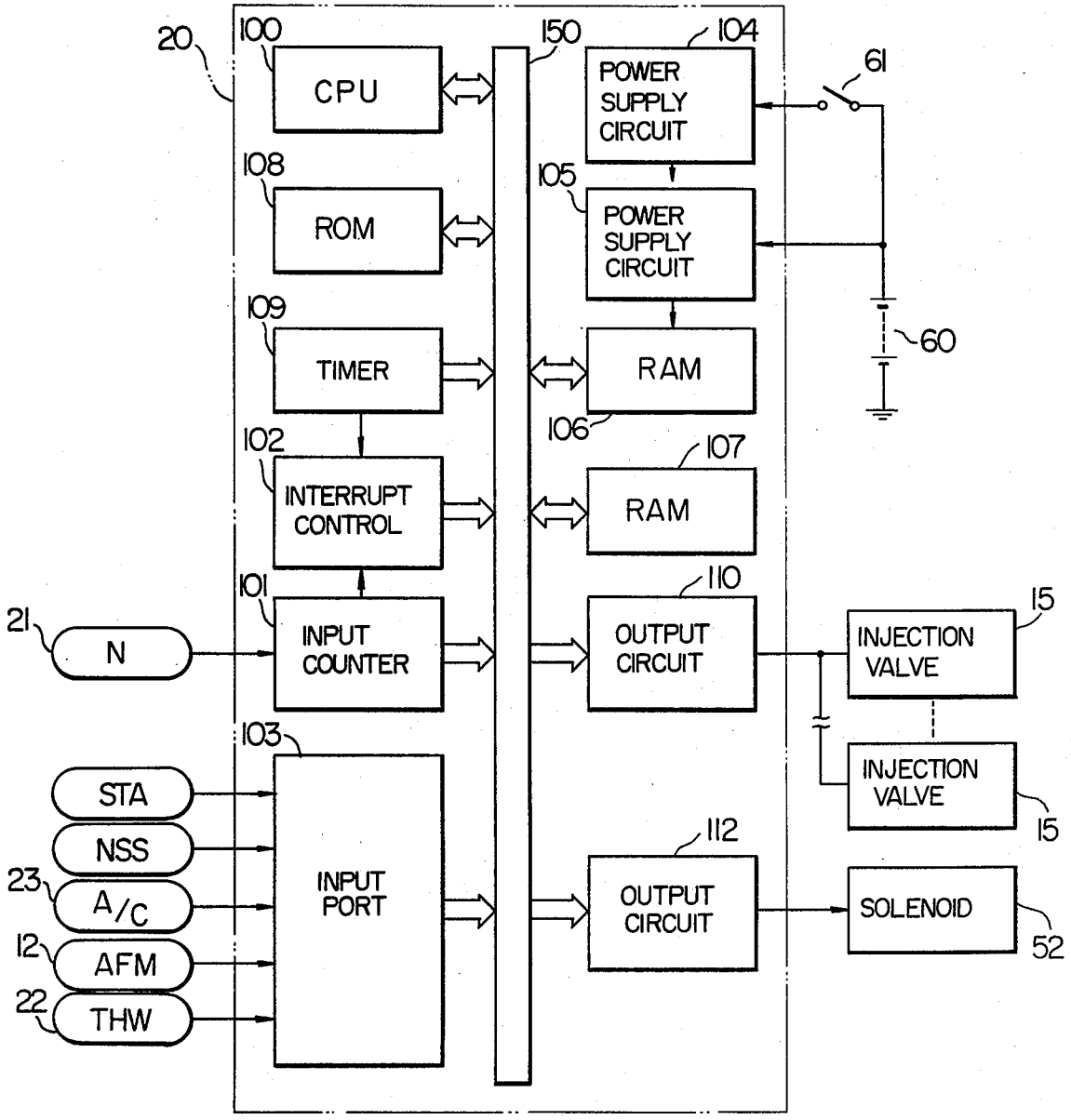
FIG. 2 is a block diagram of the computer shown in FIG. 1.

The structure of the microcomputer 20 will then be described with reference to FIG. 2. A microprocessor (CPU) 100 calculates according to a predetermined program the amount of fuel to be injected and the value of a control factor used for controlling the idling rotation speed of the engine 10. This CPU 100 is of the type commonly known in the art and is capable of processing data of 8, 12 or 16 bits.

An input counter 101 supplies to the CPU 100 a data representing the rotation speed N of the engine 10, and such a data is obtained by counting clock pulses in timed relation to the pulse signal applied from the electromagnetic pickup 21. Further, this counter 101 applies an interrupt command signal to an interrupt control unit 102 in synchronism with the rotation of the engine 10. Upon reception of this signal, the interrupt control unit 102 applies an interrupt signal to the CPU 100 by way of a bus 150.

An input port unit 103 transmits signals from various sensors to the CPU 100 by way of the bus 150 and is composed of an A/D converter, a multiplexer and other necessary parts. The signals applied to the input port unit 103 include the intake air flow-rate signal AFM from the air flow meter 12, the engine cooling water temperature signal THW from the warm-up sensor 22, the air conditioner signal A/C from the air conditioner switch 23, the neutral safety signal or torque converter signal NSS from the neutral safety switch of the automatic transmission (not shown), and the starter signal STA from the engine starter switch (not shown).

Power supply circuits 104 and 105 provide a constant voltage output by stabilizing the output voltage from a battery 60 of the vehicle. The power supply circuit 104 is connected to the battery 60 through the engine key switch 61, and the other power supply circuit 105 is connected directly to the battery 60. The latter power supply circuit 105 applies its output voltage continuously to a random access memory (RAM) 106, while the former power supply circuit 104 applies its output voltage to the units except the memory 106 when the key switch 61 is turned on.

Another random access memory (RAM) 107 is provided in addition to the RAM 106. These RAM's 106 and 107 are readable and writable memories which are actuated temporarily during execution of the program by the CPU 100. The RAM 106 is a non-volatile memory of the type backed up by a power source, and thus, its contents do not disappear even when the key switch 61 is turned off to stop the operation of the engine 10, since the power supply voltage from the power supply circuit 105 is continuously applied thereto.

A read-only memory (ROM) 108 stores the program, various constants, etc., and the CPU 100 reads out necessary data from the ROM 108 by way of the bus 150.

A timer unit 109 generates the aforementioned clock pulses and also times the elapsed length of time continuously. The timer unit 109 applies the clock signal to the CPU 100 and applies also a timer interrupt signal to the interrupt control unit 102.

An output circuit 110 is composed of a latch, a countdown counter, a power transistor and other necessary parts. The output circuit 110 generates a pulse signal having a pulse width corresponding to the required amount of injected fuel on the basis of the data representing the required amount of injected fuel calculated by the CPU 100, and such a pulse signal is applied to the fuel injection valves 15.

Another output circuit 112 similar to the output circuit 110 is also composed of a latch, a countdown counter, a power transistor and other necessary parts. This output circuit 112 generates a pulse signal having a duty ratio corresponding to the required value of the control factor on the basis of the data representing the idling rotation control factor calculated by the CPU 100, and such a pulse signal is applied to the electromagnetic coil 52 of the electromagnetic valve 51.

The operation of the apparatus of the present invention having the aforementioned construction will now be described. The CPU 100 is continuously executing the routines including the main routine and the injected fuel calculation routine of the program stored in the ROM 108. The CPU 100 starts to execute an interrupt routine for calculating the value of the idling rotation control factor in a manner as shown in FIG. 3 as soon as an interrupt signal is applied thereto from the interrupt control unit 102 in response to the application of the timer signal having a predetermined period of, for example, 50 msec from the timer unit 109.

Figure 3:
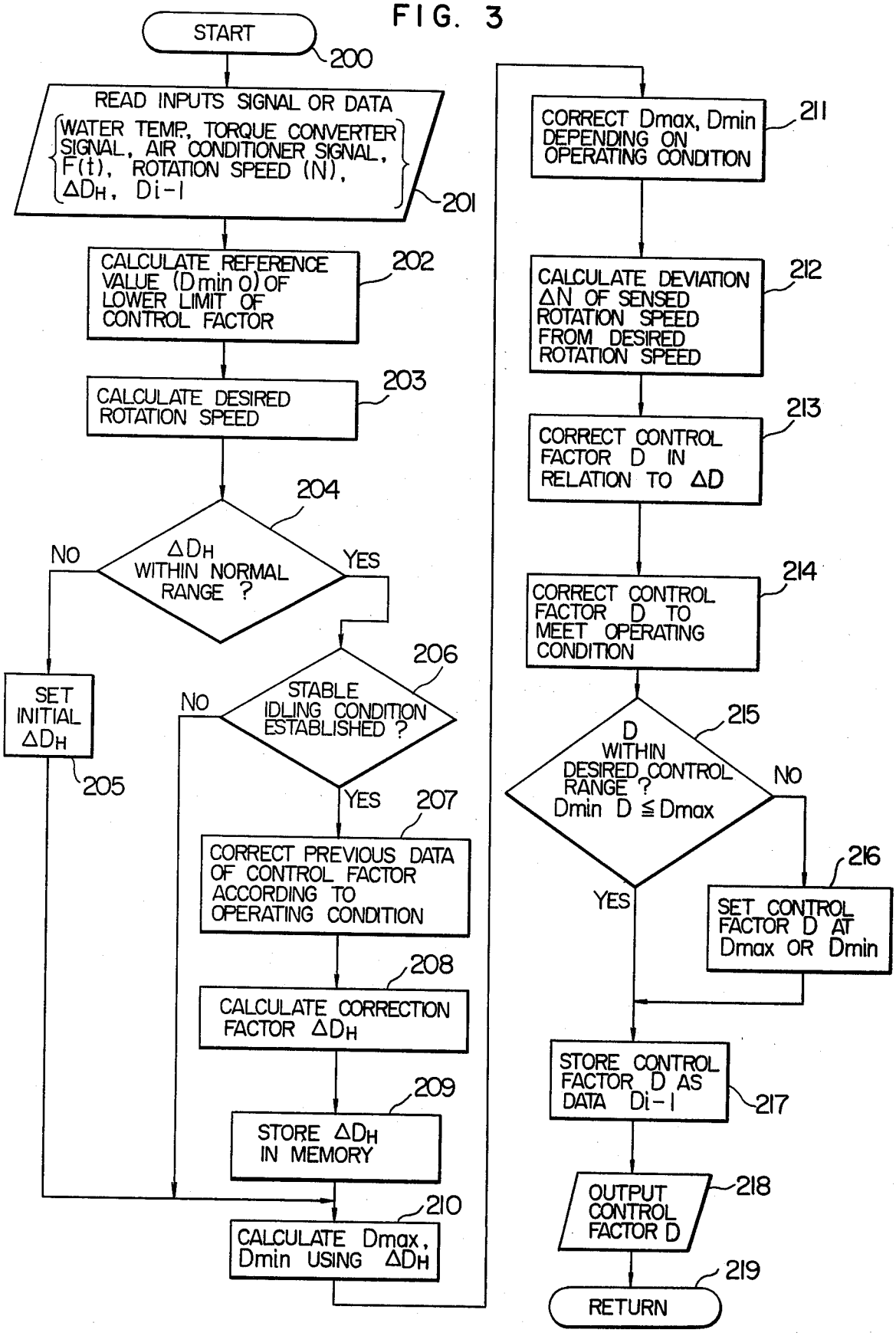
FIG. 3 is a flow chart of an interrupt routine run by the computer.

Referring to FIG. 3, the interrupt routine starts from step 200, and all the input signals and data required for the idling rotation speed control are read in step 201. These signals and data include the engine cooling water temperature signal THW, air conditioner signal A/C, torque converter signal NSS, starter signal STA, cooling water temperature function map F(t) shown in FIG. 4*a*, previous values $D_{i-1}$ of the control factor D, reference correction factor $\Delta D_H$ stored in the non-volatile memory 106, and engine rotation speed N at that time. However, when the starter signal STA indicates that the starter switch is now turned on, the previous value $D_{i-1}$ of the control factor D is not adequate now, and instead thereof an adequate value $D_{i-1}$ is calculated on the basis of the cooling water temperature function map F(t) shown in FIG. 4*a*. In step 202, a reference lower limit Dmino of the control factor D is calculated as a function of the temperature of engine cooling water using the temperature function map F(t) shown in FIG. 4*a*.

In step 203, the desired idling rotation speed $N_F$ variable depending on the operation mode is calculated. For example, this desired idling rotation speed $N_F$ is variable depending on the engine cooling water temperature, depending on whether the torque converter signal NSS indicates the neutral (N) range or drive (D) range of the automatic transmission, and depending on whether the air conditioner signal A/C indicates the on state or off state of the air conditioner as, for example, shown in FIG. 4*b*.

In step 204 following step 203, judgement is made as to whether the value of the correction factor $\Delta D_H$, which has been stored in the non-volatile memory 106 in step 201 to be used for correcting the value of the control factor D thereby controlling the idling rotation speed of the engine, lies within a normal or allowable range. In other words, judgement is made as to whether the value of $\Delta D_H$ stored in the non-volatile memory 106 has become unusual or unsuitable for use due to inadvertent disconnection of the non-volatile memory 106 from the battery terminal or any other circumstances, since this non-volatile memory 106 is directly connected to the battery 60 without being connected through the key switch 61 in the embodiment of the present invention.

When the value of $\Delta D_H$ is proved to be unusual in step 204, this step 204 is followed by step 205 in which the correction factor $\Delta D_H$ is replaced by an appropriate fixed correction factor $\Delta D_{HO}$ stored in the ROM 108 to be used as the initial setting of $\Delta D_H$, and a jump to step 210 occurs. On the other hand, step 204 is followed by step 206 when the result of judgement in step 204 proves that the correction factor $\Delta D_H$ lies within the normal or allowable range.

In step 206, judgement is made as to whether the engine is operating in a stable idling condition. For example, step 206 confirms that the air conditioner signal and torque converter signal remain unchanged from before, that the temperature of engine cooling water is higher than the setting and the engine has been sufficiently warmed up, and that the deviation of the present engine rotation speed from the previous one is less than the setting.

The engine is judged to be operating in a stable idling condition when the result of judgement in step 206 proves that all the conditions specified above are satisfied, and step 206 is followed by step 207. When, on the other hand, the result of judgement in step 206 proves that all of the above conditions are not satisfied, a jump to step 210 occurs.

In response to the conditions confirmed in step 206 such as the torque converter signal NSS is indicative of the N range or D range of the automatic transmission, and the air conditioner signal A/C is indicative of the on state or off state of the air conditioner when all the conditions specified in the step 206 were satisfied to establish the stable idling condition of the engine (since the torque converter signal NSS and the air conditioner signal A/C remain unchanged from before), the previous value $D_{i-1}$ of the control factor D is used in step 207 to calculate a value $D_{i'-1}$ of the control factor D corresponding to the selected standard idling condition in which the torque converter signal NSS is indicative of the N range of the automatic transmission and the air conditioner signal A/C is indicative of the off state of the air conditioner. For example the calculation is made of $D'_{i-l}=D_{i-l}$ (in the case of the signal NSS indicating the N range and the signal A/C indicating the off state) or $D'_{i-l}=D_{i-l}-\alpha$ (in the case of the signal NSS indicating the N range and the signal A/C indicating the on state where $\alpha$ is a constant).

In step 208, the value $D_{i'-l}$ of the control factor D calculated in step 207 is selected as an idle reference control valve $D_{ID}$ of the control factor D for controlling the idling rotation speed of the engine, and the correction factor $\Delta D_H$ is modified so that the difference between the reference value $D_{ID}$ of the control factor D and the reference lower limit $D_{min0}$ of the control factor D calculated in step 202 provides a predetermined value $\Delta H_1$. The modified correction factor $\Delta D_H$ thus obtained is stored in the RAM 106 in step 209. That is, the calculation $\Delta D_H=D_{ID}-D_{min0}-\Delta H_1$ is carried out in step 208 and stored in the RAM 106 in step 209.

In step 210, the correction factor $\Delta D_H$ stored in the RAM 106 is read out to be used for calculating an upper limit $D_{max}$ and a lower limit $D_{min}$ of the control factor D (the duty ratio) in the standard idling condition (of the engine in which the torque converter signal NSS is indicative of the N range of the automatic transmission and the air conditioner signal A/C is indicative of the off state of the air conditioner.) That is, $D_{min}=D_{min0}+\Delta D_H$ and $D_{max}=D_{min}+\Delta H_2$ (a constant) are calculated in step 210.

The routine proceeds then to step 211. In this step, the upper limit $D_{max}$ and the lower limit $D_{min}$ of the control factor D are modified depending on the operating condition of the engine, that is, depending on whether the torque converter signal NSS is indicative of the N range or D range of the automatic transmission and whether the air conditioner signal A/C is indicative of the on state or off state of the air conditioner.

Step 212 calculates the deviation $\Delta N(=N-N_F)$ of the engine rotation speed N read in step 201 from the desired rotation speed $N_F$ calculated in step 203.

Figure 4A:
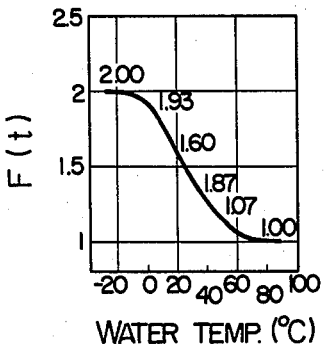
FIGS. 4*a* to 4*d* are graphs used to illustrate the operation of the apparatus according to the present invention.
Figure 4B:
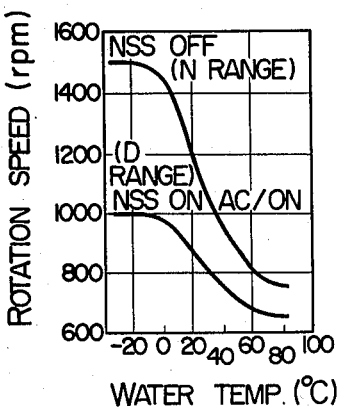
Figure 4C:
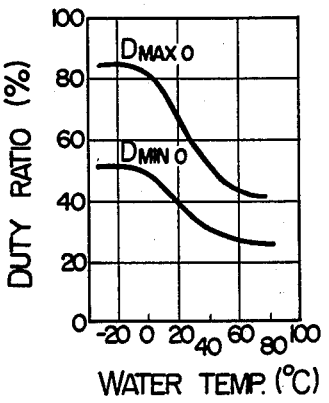
Figure 4D:
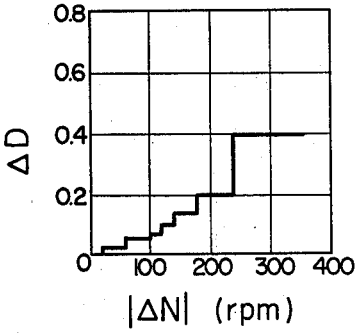

The routine then proceeds to step 213. In this step, on the basis of a map showing a control factor correction coefficient $\Delta D$ relative to the absolute value of the deviation $\Delta N$ as shown in FIG. 4*d* and depending on whether the deviation $\Delta N$ is positive or negative, the previous value $D_{i-l}$ of the control factor D read in step 201 is corrected to provide a corrected control factor D. Thus, when $\Delta N>0$, D is given by $D=D_{i-l}-\Delta D$, while when $\Delta N\leqq 0$, D is given by $D=D_{i-l}+\Delta D$, in this case.

The routine then proceeds to step 214 in which, in order to minimize an overshoot or an undershoot of the engine rotation speed due to a change of the operating condition as when the present torque converter signal NSS or air conditioner signal A/C differ from the previous one, the value of the control factor D obtained in step 213 is subjected to a predictive correction so that it meets the change in the operating condition of the torque converter or air conditioner.

In step 215, judgement is made as to whether the value of the control factor D obtained in step 214 lies within the range between the upper limit $D_{max}$ and the lower limit $D_{min}$ of the control factor D obtained in step 211, and when the result of judgement proves that D lies between $D_{max}$ and $D_{min}$, the routine proceeds to step 217. On the other hand, when the value of the control factor D lies out of the range and is larger than the upper limit $D_{max}$ or smaller than the lower limit $D_{min}$, D is set at $D_{max}$ or $D_{min}$ in step 216.

In step 217, the corrected value of the control factor D is selected as $D_{i-l}$ to be stored in the RAM 106, and in step 218, the data of the control factor D is applied from the RAM 106 to the output circuit 112. In step 219, the interrupt routine returns to the main routine. Such an interrupt routine is repeatedly run at a time interval of 50 msec.

The CPU 100 calculates the control factor D representing the duty ratio in the manner above described, and the data of the control factor D thus calculated is applied to the output circuit 112 so that it is converted into a pulse signal having the specific duty ratio to be applied to the electromagnetic valves 51.

The amount of secondary air bypassing the throttle valve 16 is so controlled that the idling rotation speed of the engine attains the desired rotation speed.

Accumulation of dust and other foreign matters on the throttle valve 16 and in the air conduits 18 and 19 functioning as the bypass passages has been undesirable in that, unless the opening of the air control valve 30 is controlled to be larger than when the throttle valve 16 and the air conduits 18, 19 are new and free from accumulation of dust and other foreign matters, the engine rotation speed cannnot be controlled to be maintained at the desired value on the basis of the measured amount of secondary air, and the computer 20 will calculate the control factor D to be relatively larger than the adequate value. Thus, when the upper limit $D_{max}$ and lower limit $D_{min}$ of the control factor D are kept fixed even in such a case, the relation therebetween will become no more appropriate for the purpose of rotation speed control. In the present invention, a correction factor $\Delta D_H$ related to the control factor D is stored in a RAM, and the upper limit $D_{max}$ and lower limit $D_{min}$ of the control factor D are calculated on the basis of this correction factor $\Delta D_H$. Therefore, the relation between the control factor D (the duty ratio) and its upper limit $D_{max}$ and lower limit $D_{min}$ is maintained appropriate for the control purpose, so than an undesirable engine trouble such as engine stalling during a variation in the load or in a transient state of engine operation can be reliably prevented.

In the aforementioned embodiment of the present invention, a RAM of the type backed up by a power source is employed as one form of the non-volatile memory. However, this non-volatile memory may be of the type employing an MNOS type transistor.

In the aforementioned embodiment of the present invention, the reference value $D_{ID}$ of the control factor D for controlling the idling rotation speed of the engine is stored in a non-volatile memory by way of example. However, a volatile memory may be used in lieu of the non-volatile memory when, for example, the F(t) map shown in FIG. 4*a* is based to calculate the upper limit $D_{max}$ and lower limit $D_{min}$ of the control factor D required until the stable idling condition is first established after the engine key switch 61 has been turned on.

It will be understood from the foregoing detailed description that, in the method and apparatus of the present invention for controlling the idling rotation speed of an engine by feeding back the deviation of the actual rotation speed from the desired rotation speed, the upper limit and lower limit of the control factor are determined on the basis of a correction factor related to the control factor selected to establish the stable idling condition of the engine. Therefore, even when dust and other foreign matters may accumulate on the throttle valve and in the air bypass passages due to, for example, a long period of time of use of the engine, the appropriate relation between the control factor and its upper and lower limits can always be reliably maintained to prevent an unusual increase or decrease in the engine rotation speed against the will of the vehicle driver. The vehicle driver will not feel uneasy or unpleasant during the drive, and an undesirable engine trouble such as engine stalling would not occur during, for example, a variation in the load.

What is claimed is:

1. A method of controlling the rotation speed of an engine of a vehicle having an automatic transmission and an air conditioner comprising the steps of:

calculating a desired value of the idling rotation speed of the engine;

sensing the actual idling rotational speed of the engine;

calculating the deviation of the sensed actual idling rotation speed from the desired value;

calculating and storing a data of an idling rotation speed control factor on the basis of said deviation;

calculating and storing a reference correction factor in dependence upon the stored data of said control factor and a preset standard idling condition data of the engine;

calculating and storing an upper limit and a lower limit of said control factor using the stored value of said reference correction factor;

controlling to limit said control factor so that its value lies within the control range between said upper limit and said lower limit, and storing the limited value of said rotation speed control factor in place of said stored data; and controlling the amount of intake air or the amount of the air-fuel mixture supplied to the engine on the basis of the newly stored data of said control factor.

2. A method as claimed in claim 1, wherein the data of said rotation speed control factor is calculated on the basis of a reference value of the lower limit of said control factor obtained from a cooling water temperature function map.

3. A method as claimed in claim 1, wherein said desired value of the rotation speed is calculated on the basis of a rotation speed characteristic map mapping the rotation speed relative to the cooling water temperature, torque converter signal and air conditioner signal.

4. A method as claimed in claim 1, 2 or 3, wherein judgment is made as to whether the value of said reference correction factor is unusual or not, and, when the result of judgement proves that the value of said reference correction factor is unusual, it is replaced by a predetermined fixed correction factor so that the latter is used as an initial setting.

5. A method as claimed in claim 2, wherein said reference correction factor to be stored is calculated on the basis of a data of said control factor in the standard idling condition in which the torque converter signal is indicative of the N range of the automatic transmission and the air conditioner signal is indicative of the off state of the air conditioner and also on the basis of the reference value of said lower limit, and the value of said correction factor is added to the reference value of said lower limit to provide the lower limit of said control factor in the standard idling condition, a predetermined constant being added to the thus obtained lower limit to provide the upper limit of said control factor in the standard idling condition.

6. A method as claimed in claim 1, wherein, when the sensed rotation speed of the engine is lower than the desired value, a control factor correction coefficient given by a function of said rotation speed deviation is added to the stored data of said control factor to use the result of addition as said control factor, while when the sensed rotation speed of the engine is higher than the desired value, said control factor correction coefficient is subtracted from the stored data of said control factor to use the result of subtraction as said control factor, and said control factor is set at said upper limit when the former is larger than the latter, but it is set at said lower limit when the former is smaller than the latter.

7. An apparatus for controlling the idle speed of an engine of a vehicle having an automatic transmission and an air conditioner comprising:

an air control valve disposed in an air conduit for controlling the speed of the engine;

engine operation sensor means including at least an engine speed sensor, a warm-up sensor, a torque converter signal sensor and an air-conditioner signal sensor;

a microcomputer executing the steps of calculating a desired value of the idling speed of the engine in response to the outputs from said sensor means, calculating the deviation of the actual idling speed from the desired value, calculating a data of a speed control factor on the basis of said deviation, limiting said control factor to within a control range between an upper limit and a lower limit, storing a correction factor related to a value of said control factor used under a specific operating condition of the engine and calculating the upper limit and the lower limit of said control factor using the value of said correction factor; and actuator means for controlling said air control valve on the basis of said control factor limited to between said upper limit and said lower limit.

8. An apparatus as claimed in claim 7, wherein said microcomputer includes a read-only memory (ROM) and a random access memory (RAM), the latter being a non-volatile memory.

9. An apparatus as claimed in claim 8, wherein said microcomputer further includes interrupt control means for generating an interrupt signal in synchronism with the rotation of the engine, timer means for generating a timer interrupt signal, and a central processor and output circuit means for generating a pulse signal having a duty ratio corresponding to the calculated data of said control factor thereby controlling the amount of intake air or the amount of the air-fuel mixture supplied to the engine.

* * * * *